US010605498B2

(12) United States Patent
Okazaki

(10) Patent No.: US 10,605,498 B2
(45) Date of Patent: Mar. 31, 2020

(54) HEAT PUMP APPARATUS

(71) Applicant: Mitsubishi Electric Corporation, Tokyo (JP)

(72) Inventor: Takashi Okazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 195 days.

(21) Appl. No.: 15/108,664

(22) PCT Filed: Jan. 23, 2014

(86) PCT No.: PCT/JP2014/051429
§ 371 (c)(1),
(2) Date: Jun. 28, 2016

(87) PCT Pub. No.: WO2015/111175
PCT Pub. Date: Jul. 30, 2015

(65) Prior Publication Data
US 2016/0320105 A1 Nov. 3, 2016

(51) Int. Cl.
*F25B 13/00* (2006.01)
*F25B 7/00* (2006.01)
(Continued)

(52) U.S. Cl.
CPC ..... *F25B 25/005* (2013.01); *F25B 7/00* (2013.01); *F25B 13/00* (2013.01); *F25B 40/00* (2013.01);
(Continued)

(58) Field of Classification Search
CPC .... F25B 25/005; F25B 13/00; F25B 2500/01; F25B 2500/221; F25B 2313/02741;
(Continued)

(56) References Cited

U.S. PATENT DOCUMENTS 5,044,172 A * 9/1991 Inoue ..... F24F 3/08 62/335
5,784,893 A * 7/1998 Furuhama ..... C09K 5/041 62/333
(Continued)

FOREIGN PATENT DOCUMENTS

CN 1415062 A 4/2003
JP H06-241596 A 8/1994
(Continued)

OTHER PUBLICATIONS

Engineering ToolBox, (2003). Equivalent Diameter. [online] Available at: https://www.engineeringtoolbox.com/equivalent-diameter-d_205.html [Accessed Mar. 29, 2018].*
(Continued)

*Primary Examiner* — Cassey D Bauer
*Assistant Examiner* — Miguel A Diaz
(74) *Attorney, Agent, or Firm* — Posz Law Group, PLC

(57) ABSTRACT

A heat pump apparatus includes a heat source-side refrigeration cycle sequentially connecting a compressor, a heat source-side heat exchanger, an expansion valve, and a heat source side of a cascade heat exchanger, and configured to circulate refrigerant, and a load-side refrigeration cycle sequentially connecting a heat medium sending unit, a load-side heat exchanger, and a load side of the cascade heat exchanger, and configured to circulate a heat medium. The heat source-side heat exchanger and the cascade heat exchanger each have a hydraulic diameter of less than 1 mm, which is calculated by 4×S/L, where S represents a cross-sectional area of a fluid passage and L represents a length of a wetted perimeter.

10 Claims, 2 Drawing Sheets

(51) Int. Cl.
*F25B 25/00* (2006.01)
*F25B 40/00* (2006.01)

(52) U.S. Cl.
CPC . *F25B 2313/003* (2013.01); *F25B 2313/0233* (2013.01); *F25B 2313/0272* (2013.01); *F25B 2313/02741* (2013.01); *F25B 2400/06* (2013.01); *F25B 2400/12* (2013.01); *F25B 2500/01* (2013.01); *F25B 2500/221* (2013.01)

(58) Field of Classification Search
CPC ..... F25B 2313/0233; F25B 2313/0272; F25B 2313/003; F25B 2400/06; F25B 2400/12; F25B 7/00
See application file for complete search history.

(56) References Cited

U.S. PATENT DOCUMENTS 6,094,925 A * 8/2000 Arshansky ..... F25B 25/005 62/151
6,694,773 B1 * 2/2004 Snow ..... F25B 39/04 62/474
9,970,689 B2 * 5/2018 Schutte ..... F25B 13/00
9,982,920 B2 * 5/2018 Feng ..... F25B 9/008
2002/0189280 A1 * 12/2002 Taira ..... C09K 5/045 62/502
2003/0140642 A1 * 7/2003 Quilliard ..... B60H 1/00785 62/186
2004/0011062 A1 * 1/2004 Taira ..... C09K 5/045 62/114
2006/0191286 A1 * 8/2006 Park ..... F25B 13/00 62/434
2008/0076342 A1 * 3/2008 Bryant ..... B60H 1/00735 454/75
2008/0127667 A1 * 6/2008 Buckley ..... F25B 45/00 62/324.4
2010/0058800 A1 * 3/2010 Setoguchi ..... F25B 13/00 62/513
2010/0107665 A1 * 5/2010 Kawano ..... F25B 13/00 62/149
2010/0205987 A1 * 8/2010 Okazaki ..... F25B 9/008 62/190
2010/0223940 A1 * 9/2010 Kotani ..... F25B 45/00 62/149
2011/0225998 A1 * 9/2011 Yamashita ..... F24F 3/065 62/126
2012/0037352 A1 * 2/2012 Osaka ..... B60H 1/00021 165/202
2012/0180513 A1 7/2012 Yamashita et al.
2012/0222441 A1 * 9/2012 Sawada ..... B60H 1/00392 62/238.1
2013/0098085 A1 * 4/2013 Judge ..... H05K 7/20827 62/180
2013/0180278 A1 * 7/2013 Yamashita ..... F25B 6/04 62/335
2014/0007607 A1 * 1/2014 Tamura ..... F25B 13/00 62/324.6
2014/0196483 A1 * 7/2014 Okazaki ..... F25B 49/02 62/79
2015/0075202 A1 * 3/2015 Okuda ..... F25B 39/00 62/324.4
2015/0089971 A1 * 4/2015 Furui ..... F25B 13/00 62/434
2015/0191182 A1 * 7/2015 Abou Eid ..... B61D 27/0018 62/80
2015/0276271 A1 * 10/2015 Uselton ..... F25B 1/06 62/115
2015/0330675 A1 * 11/2015 Tamaki ..... F25B 13/00 62/324.1
2016/0084539 A1 * 3/2016 Schutte ..... F25B 13/00 62/498
2016/0258657 A1 * 9/2016 Feng ..... F25B 9/008
2017/0016654 A1 * 1/2017 Shimazu ..... F25B 31/004
2017/0074559 A1 * 3/2017 Park ..... F25B 1/00
2017/0191705 A1 * 7/2017 Sethi ..... F25B 7/00
2018/0023848 A1 * 1/2018 Uselton ..... F25B 1/06
2018/0372354 A1 * 12/2018 Brizendine ..... F24F 11/72

FOREIGN PATENT DOCUMENTS

JP 07269964 A * 10/1995 ..... C09K 5/08
JP H08-005197 A 1/1996
JP H11-101517 A 4/1999
JP 2001-194081 A 7/2001
JP 2001-248922 A 9/2001
JP 2002-295915 A 10/2002
JP 2003-004396 A 1/2003
JP 2003004396 A * 1/2003 ..... F28F 13/18
JP 2003004396 A * 1/2003 ..... F28F 13/18
JP 2004-239503 A 8/2004
JP 2010-096372 A 4/2010
JP 2013-044469 A 3/2013
JP 2013-148328 A 8/2013
WO 2013/038577 A1 3/2013
WO WO-2013038577 A1 * 3/2013 ..... F25B 49/02
WO WO-2015132951 A1 * 9/2015

OTHER PUBLICATIONS

Engineering ToolBox, (2003). Hydraulic Diameter. [online] Available at: https://www.engineeringtoolbox.com/hydraulic-equivalent-diameter-d_458.html [Accessed Mar. 29, 2018].*
Bright Hub Engineering. (Jan. 28, 2010). Heat Exchanger Flow Patterns. Retrieved Mar. 30, 2018, from https://www.brighthubengineering.com/hvac/62410-heat-exchanger-flow-patterns/.*
Translation of Uchida et al. (JP 2003004396 A). (Year: 2019).*
Turpin, J. R. (Feb. 27, 2006). HVAC Turns 13!: Weighing in on Changing Out Indoor Coil. Retrieved Apr. 13, 2019, from https://www.achrnews.com/articles/97618-hvac-turns-13-weighing-in-on-changing-out-indoor-coil (Year: 2006).*
Office Action dated Apr. 18, 2017 issued in corresponding JP patent application No. 2015-558653 (and English translation).
Office Action dated Oct. 11, 2016 issued in corresponding JP patent application No. 2015-558653 (and English translation).
Office Action dated Jul. 17, 2017 issued in corresponding CN patent application No. 2014800738447(and English translation).
Office Action dated Jan. 5, 2018 issued in corresponding CN patent application No. 201480073844.7 (and English translation).
International Search Report of the International Searching Authority dated Apr. 15, 2014 for the corresponding international application No. PCT/JP2014/051429 (and English translation).
Extended European Search Report dated Sep. 8, 2017 issued in corresponding EP patent application No. 14879730.1.
Office Action dated Jun. 11, 2018 issued in corresponding CN patent application No. 201480073844.7 (and English translation).
Notification of Reexamination dated Sep. 24, 2019 issued in corresponding CN patent application No. 201480073844.7 (and Machine translation).

* cited by examiner

HEAT PUMP APPARATUS

CROSS REFERENCE TO RELATED APPLICATION

This application is a U.S. national stage application of PCT/JP2014/051429 filed on Jan. 23, 2014, the contents of which are incorporated herein by reference.

TECHNICAL FIELD

The present invention relates to a heat pump apparatus using flammable refrigerant in a heat source-side refrigeration cycle.

BACKGROUND

A fluorinated compound, such as R410 that is an HFC-based refrigerant, has widely been used as conventional refrigerant for a heat pump apparatus of a refrigerator-freezer, an air-conditioning apparatus, or other apparatus. However, such a refrigerant significantly influences global warming. Thus, it is desired to use a refrigerant less influencing global warming from the viewpoint of preventing global warming. Under such a background, there has been proposed use of a refrigerant less influencing global warming, such as R32 that is an HFC-based refrigerant, R1234yf that is an HFO-based refrigerant, and propane or isobutane that is a hydrocarbon-based refrigerant. However, these refrigerants are all flammable refrigerants (or slightly flammable refrigerants) unlike the HFC-based refrigerant that has conventionally been used.

In the heat pump apparatus using these kinds of flammable refrigerants, there is a risk in that refrigerant leaks indoors from a heat exchanger or a pipe constituting a refrigeration cycle to cause an accident, such as fire. In view of the risk, there has been proposed a heat pump apparatus of an indirect heat exchange system, in which the heat pump apparatus is divided into a primary-side refrigeration cycle located on a heat source side and a secondary-side refrigeration cycle located on a load side, thereby preventing the indoor leakage of refrigerant on the load side (see, for example, Patent Literature 1).

The heat pump apparatus includes the primary-side refrigeration cycle including a compressor, a heat source-side heat exchanger, an expansion valve, a four-way valve, and a cascade heat exchanger, and the secondary-side refrigeration cycle including a load-side heat exchanger, a pump configured to send water, a four-way valve, and the cascade heat exchanger. The cascade heat exchanger includes fluid passages each including a plurality of perforated flat tubes and small-diameter heat transfer tubes in combination, and a hydraulic diameter of each of the fluid passages is 3 mm or less and 0.5 mm or more.

PATENT LITERATURE

Patent Literature 1: Japanese Unexamined Patent Application Publication No. 2003-4396 (see, for example, claim 3 and FIG. 7)

However, in the related-art heat pump apparatus disclosed in Patent Literature 1, there is a significant difference between an internal volume of the fluid passage for refrigerant of the cascade heat exchanger and an internal volume of the fluid passage for refrigerant of the heat source-side heat exchanger. Thus, a necessary sealing amount of refrigerant differs between a cooling operation and a heating operation, thereby causing a problem in that the sealing amount of refrigerant cannot be reduced. Further, there is a problem in that the primary-side refrigeration cycle does not have a configuration with high safety to take measures against refrigerant leakage.

SUMMARY

The present invention has been made to solve at least one of the problems as described above, and thus has an object to provide a heat pump apparatus reduced in sealing amount of refrigerant.

A heat pump apparatus according to the present invention includes a heat source-side refrigeration cycle sequentially connecting a compressor, a heat source-side heat exchanger, an expansion valve, and a heat source side of a cascade heat exchanger, the heat source-side refrigeration cycle being configured to circulate refrigerant, and a load-side refrigeration cycle sequentially connecting a heat medium sending unit, a load-side heat exchanger, and a load side of the cascade heat exchanger, the load-side refrigeration cycle being configured to circulate a heat medium. The heat source-side heat exchanger and the cascade heat exchanger each have a hydraulic diameter of less than 1 mm, which is calculated by 4×S/L, where S represents a cross-sectional area of a fluid passage and L represents a length of a wetted perimeter.

In the heat pump apparatus according to the present invention, a microchannel heat exchanger (flat tube) having a fluid passage having small internal volume and having a hydraulic diameter of less than 1 mm is used as the outdoor heat exchanger and the cascade heat exchanger in the primary-side refrigeration cycle configured to circulate refrigerant, thereby being capable of reducing a sealing amount of flammable refrigerant.

DETAILED DESCRIPTION

Figure 1:
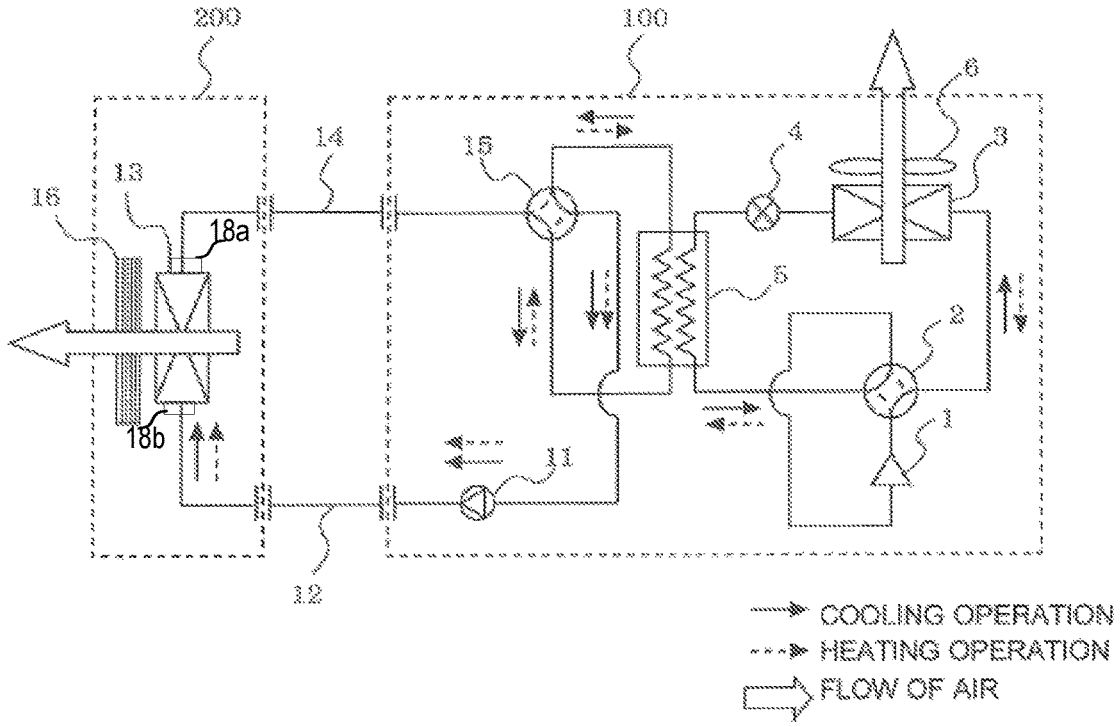
FIG. 1 is a schematic diagram for illustrating a heat pump apparatus according to Embodiment 1 of the present invention.

Embodiments of the present invention are described below with reference to the drawings. Note that, the present invention is not limited to the embodiments described below. Further, in the drawings referred to below, the size relationship between components may be different from that of actual components.

Embodiment 1

FIG. 1 is a schematic diagram for illustrating a heat pump apparatus according to Embodiment 1 of the present invention.

The heat pump apparatus according to Embodiment 1 of the present invention includes an outdoor unit 100, an indoor unit 200, and connection pipes 12 and 14.

The outdoor unit 100 includes a primary-side (heat source-side) refrigeration cycle configured to circulate refrigerant, including a compressor 1, a four-way valve (flow switching device) 2, an outdoor heat exchanger 3 serving as a heat source-side heat exchanger, an expansion valve 4, and a heat source side of a cascade heat exchanger 5, and a secondary-side (load-side) refrigeration cycle configured to circulate a heat medium, including a pump 11 serving as a heat medium sending unit variable in rotation speed, a four-way valve (flow switching device) 15, and a load side of the cascade heat exchanger 5.

The indoor unit 200 accommodates an indoor heat exchanger 13 serving as a load-side heat exchanger.

The outdoor heat exchanger 3 has an outdoor fan 6 configured to supply outdoor air, and the indoor heat exchanger 13 has an indoor fan 16 configured to supply indoor air.

In this case, as the outdoor heat exchanger 3 and the cascade heat exchanger 5, there is used a microchannel heat exchanger (flat tube) with high heat exchange efficiency, having a fluid passage having small internal volume (that is, reduced in necessary refrigerant amount). The microchannel heat exchanger refers to a heat exchanger having a hydraulic diameter of less than 1 mm, which is calculated by $4\times S/L$, where S represents a cross-sectional area per fluid passage and L represents a length of a wetted perimeter (circumferential length of an inner wall surface of a fluid passage). Water is used as a heat medium for the secondary-side refrigeration cycle, and flammable refrigerant (or slightly flammable refrigerant), such as propane and isobutane, is used as refrigerant for the primary-side refrigeration cycle. When V1 represents an internal volume of a fluid passage for refrigerant of the outdoor heat exchanger 3 and V2 represents an internal volume of a fluid passage for refrigerant of the cascade heat exchanger 5, V1 and V2 are set to satisfy a relationship of $0.9<(V1/V2)<1.1$. The reason therefor is described later.

Next, an operation of the heat pump apparatus according to Embodiment 1 of the present invention is described.

[Cooling Operation]

First, during a cooling operation, the four-way valve 2 in the primary-side refrigeration cycle and the four-way valve 15 are connected as indicated by the solid lines.

Gas refrigerant compressed into high-temperature and high-pressure gas refrigerant by the compressor 1 passes through the four-way valve 2 to flow into the outdoor heat exchanger 3. Then, the gas refrigerant exchanges heat with outdoor air in the outdoor heat exchanger 3, and rejects heat to the outdoor air so that the gas refrigerant itself is condensed into high-temperature and high-pressure liquid refrigerant. The refrigerant flowing out of the outdoor heat exchanger 3 is expanded into low-temperature and low-pressure two-phase refrigerant by the expansion valve 4. The two-phase refrigerant flows into the heat source side of the cascade heat exchanger 5 acting as an evaporator. Then, the two-phase refrigerant exchanges heat with water circulating through the secondary-side refrigeration cycle in the cascade heat exchanger 5, and removes heat from the water to cool the water so that the two-phase refrigerant itself turns into low-temperature and low-pressure gas refrigerant. Then, the gas refrigerant flowing out of the heat source side of the cascade heat exchanger 5 passes through the four-way valve 2 to return to the compressor 1.

Meanwhile, in the secondary-side refrigeration cycle, the water cooled through the heat removal by the refrigerant in the cascade heat exchanger 5 is discharged by the pump 11, and passes through the connection pipe 12 to flow into the indoor heat exchanger 13. Then, the water exchanges heat with indoor air in the indoor heat exchanger 13, and removes heat from the indoor air to cool an indoor space so that the water itself is increased in temperature. The water flowing out of the indoor heat exchanger 13 passes through the connection pipe 14 and the four-way valve 15 to flow into the load side of the cascade heat exchanger 5. Then, the water exchanges heat with refrigerant in the cascade heat exchanger 5, and rejects heat to the refrigerant in quantity corresponding to the heat removed from the indoor air so that the water is cooled. Then, the water flowing out of the load side of the cascade heat exchanger 5 returns to the pump 11.

[Heating Operation]

Next, during a heating operation, the four-way valve 2 in the primary-side refrigeration cycle and the four-way valve 15 are connected as indicated by the dotted lines.

Gas refrigerant compressed into high-temperature and high-pressure gas refrigerant by the compressor 1 passes through the four-way valve 2 to flow into the heat source side of the cascade heat exchanger 5 acting as a condenser. Then, the gas refrigerant exchanges heat with water circulating through the secondary-side refrigeration cycle in the cascade heat exchanger 5, and rejects heat to the water to heat the water so that the gas refrigerant itself is condensed into high-temperature and high-pressure liquid refrigerant. The liquid refrigerant flowing out of the heat source side of the cascade heat exchanger 5 is decompressed into low-temperature and low-pressure two-phase refrigerant by the expansion valve 4. The two-phase refrigerant flows into the outdoor heat exchanger 3. Then, the two-phase refrigerant exchanges heat with outdoor air in the outdoor heat exchanger 3, and removes heat from the outdoor air so that the two-phase refrigerant itself is evaporated into low-temperature and low-pressure gas refrigerant. Then, the gas refrigerant flowing out of the outdoor heat exchanger 3 passes through the four-way valve 2 to return to the compressor 1.

Meanwhile, in the secondary-side refrigeration cycle, the water heated through the heat removal from the refrigerant in the cascade heat exchanger 5 is discharged by the pump 11, and passes through the connection pipe 12 to flow into the indoor heat exchanger 13. Then, the water exchanges heat with indoor air in the indoor heat exchanger 13, and rejects heat to the indoor air to heat the indoor space so that the water itself is decreased in temperature. The water flowing out of the indoor heat exchanger 13 passes through the connection pipe 14 and the four-way valve 15 to flow into the load side of the cascade heat exchanger 5. Then, the water exchanges heat with refrigerant in the cascade heat exchanger 5, and removes heat from the refrigerant in quantity corresponding to the heat rejected to the indoor air so that the water is heated. Then, the water flowing out of the load side of the cascade heat exchanger 5 returns to the pump 11.

In the heat pump apparatus according to Embodiment 1, the microchannel heat exchanger having the fluid passage having small internal volume is used as the outdoor heat exchanger 3 and the cascade heat exchanger 5 in the primary-side refrigeration cycle configured to circulate refrigerant, thereby being capable of reducing a sealing amount of flammable refrigerant. Further, the internal volume V1 of the fluid passage for refrigerant of the outdoor heat exchanger 3 and the internal volume V2 of the fluid passage for refrigerant of the cascade heat exchanger 5 are set to satisfy the relationship of 0.9<(V1/V2)<1.1. Thus, a necessary sealing amount of refrigerant is substantially equal in both the cooling operation and the heating operation, thereby being capable of significantly reducing the sealing amount of flammable refrigerant.

Thus, the sealing amount of refrigerant can be set to be less than the permissible sealing amount of refrigerant of the European Standards (for example, IEC standards) (about 150 g in a case of propane). Further, the necessary sealing amount of refrigerant is substantially equal in both the cooling operation and the heating operation. Thus, a refrigerant storage tank (not shown) configured to absorb refrigerant in amounts different between the two operations is unnecessary.

In this manner, a heat pump apparatus with high safety and high degree of freedom in installation can be obtained.

Further, during both the cooling operation and the heating operation, the refrigerant and the water flow in directions reverse to each other in the cascade heat exchanger 5, and the water and the indoor air flow in directions reverse to each other in the indoor heat exchanger 13, thereby being capable of obtaining a heat pump apparatus having high performance with high heat exchange efficiency.

In a case where the refrigerant storage tank is not provided, when V1/V2 is 0.9 or less, the internal volume of the fluid passage for refrigerant of the outdoor heat exchanger 3 is significantly reduced. Thus, the refrigerant cannot sufficiently be contained in the outdoor heat exchanger 3 during the cooling operation, thereby causing an inconvenience of return of a liquid to the compressor 1 or other inconveniences. Further, when V1/V2 is 1.1 or more, similarly, the internal volume of the fluid passage for refrigerant of the cascade heat exchanger 5 is significantly reduced. Thus, the refrigerant cannot sufficiently be contained in the cascade heat exchanger 5 during the heating operation, thereby causing liquid return to the compressor 1 or other inconveniences.

Figure 2:
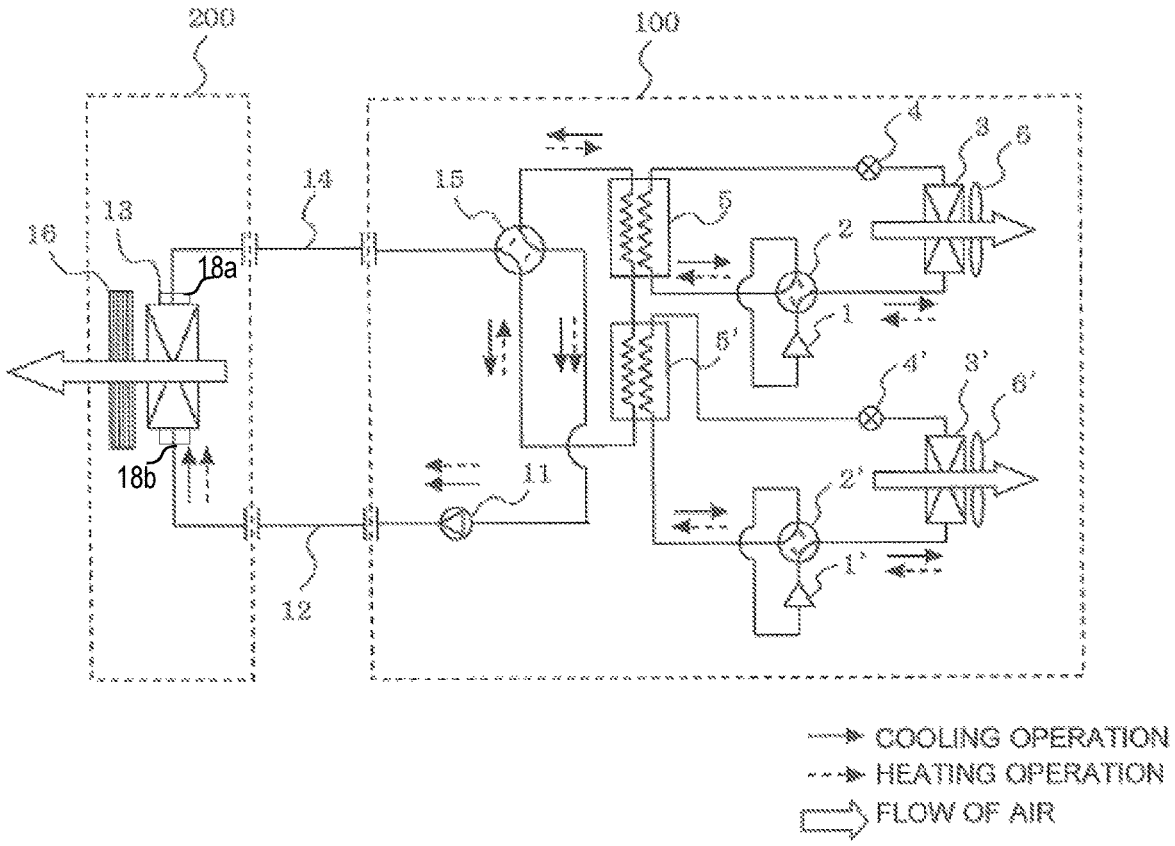
FIG. 2 is a diagram for illustrating a modification example of the heat pump apparatus according to Embodiment 1 of the present invention.

Further, when necessary performance is increased to increase the size of the heat pump apparatus, as illustrated in FIG. 2, it is only necessary that two primary-side refrigeration cycles be connected to the secondary-side refrigeration cycle in parallel, thereby reducing a sealing amount of refrigerant per primary-side refrigeration cycle. Even when high performance is required as described above, the sealing amount of refrigerant per primary-side refrigeration cycle is reduced so that the sum of the sealing amounts of refrigerant of the two refrigeration cycles is less than the permissible sealing amount of refrigerant, and the plurality of modularized primary-side refrigeration cycles are connected, thereby being capable of constructing a heat pump apparatus with high air conditioning performance.

In the above, the description is given of the example where the two primary-side refrigeration cycles are connected to the secondary-side refrigeration cycle in parallel. However, three or more primary-side refrigeration cycles may be connected to the secondary-side refrigeration cycle.

Further, when the outdoor heat exchanger 3 includes header distributors 18*a*, 18*b* arranged in upper and lower parts thereof as in a fin-less heat exchanger or a corrugated fin-and-tube heat exchanger, a bonding process for fins and tubes is not required, thereby being capable of simplifying the heat exchanger.

Still further, the passages are switched by using the four-way valves 2, 2', and 15 each serving as the flow switching device. However, a two-way valve and a three-way valve may be used in combination to switch the passages.

Yet further, the water is used as the heat medium for the secondary-side refrigeration cycle, but the heat medium is not limited thereto. An antifreeze solution or other heat media may be used.

Embodiment 2

Embodiment 2 of the present invention is described below. Differences from Embodiment 1 are mainly described, and redundant description is thus omitted herein. Further, the same components as those of Embodiment 1 are denoted by the same reference signs.

Figure 3:
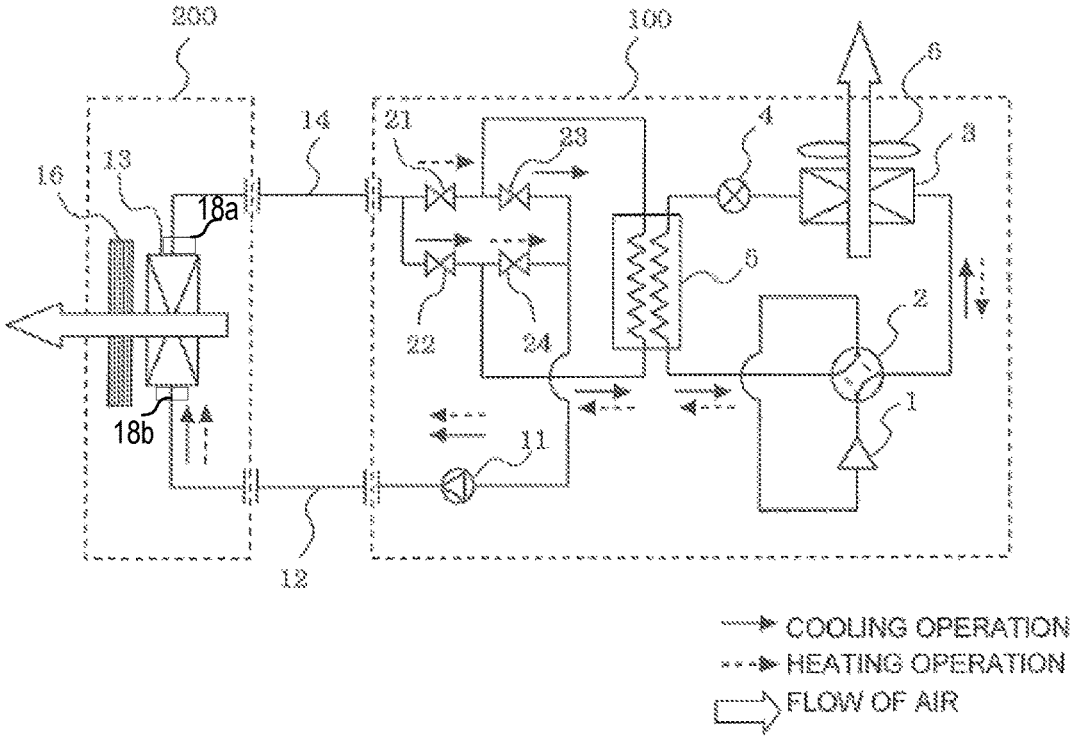
FIG. 3 is a schematic diagram for illustrating a heat pump apparatus according to Embodiment 2 of the present invention.

FIG. 3 is a schematic diagram for illustrating a heat pump apparatus according to Embodiment 2 of the present invention.

The heat pump apparatus according to Embodiment 2 has the same configuration as that of the heat pump apparatus according to Embodiment 1 except that the four-way valve 15 is constituted by four on-off valves 21 to 24 as illustrated in FIG. 3. Detailed description is thus omitted herein, and only an operation of the secondary-side refrigeration cycle is described.

[Cooling Operation]

In the secondary-side refrigeration cycle during the cooling operation, water cooled through heat removal by refrigerant in the cascade heat exchanger 5 is discharged by the pump 11, and passes through the connection pipe 12 to flow into the indoor heat exchanger 13. Then, the water exchanges heat with indoor air in the indoor heat exchanger 13, and removes heat from the indoor air to cool an indoor space so that the water itself is increased in temperature. The water flowing out of the indoor heat exchanger 13 passes through the connection pipe 14 and the on-off valve 22 to flow into the load side of the cascade heat exchanger 5. Then, the water exchanges heat with refrigerant in the cascade heat exchanger 5, and rejects heat to the refrigerant in quantity corresponding to the heat removed from the indoor air so that the water is cooled. Then, the water flowing out of the load side of the cascade heat exchanger 5 passes through the on-off valve 23 to return to the pump 11.

[Heating Operation]

Next, in the secondary-side refrigeration cycle during the heating operation, water heated through heat removal from refrigerant in the cascade heat exchanger 5 is discharged by the pump 11, and passes through the connection pipe 12 to flow into the indoor heat exchanger 13. Then, the water exchanges heat with indoor air in the indoor heat exchanger 13, and rejects heat to the indoor air to heat the indoor space so that the water itself is decreased in temperature. The water flowing out of the indoor heat exchanger 13 passes through the connection pipe 14 and the on-off valve 21 to flow into the load side of the cascade heat exchanger 5. Then, the water exchanges heat with refrigerant in the cascade heat exchanger 5, and removes heat from the refrigerant in quantity corresponding to the heat rejected to the indoor air so that the water is heated. Then, the water flowing out of the load side of the cascade heat exchanger 5 passes through the on-off valve 24 to return to the pump 11.

As described above, in Embodiment 2, the four on-off valves 21 to 24 are used instead of the four-way valve in the secondary-side refrigeration cycle, and hence pressure loss is small as in a water circuit. Thus, even when a pressure difference required for an opening and closing operation of the four-way valve is not obtained, an effect of being capable of reliably performing the opening and closing operation is obtained.

Embodiment 3

Embodiment 3 of the present invention is described below. Differences from Embodiment 1 are mainly described, and redundant description is thus omitted herein. Further, the same components as those of Embodiment 1 are denoted by the same reference signs.

Figure 4:
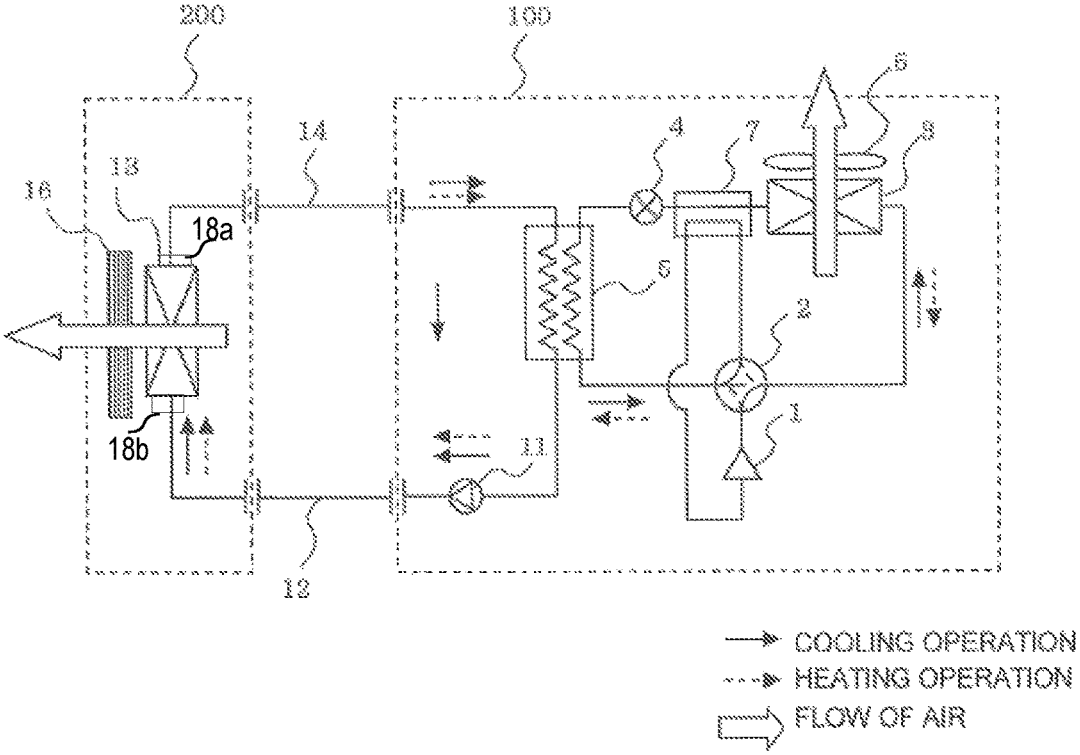
FIG. 4 is a schematic diagram for illustrating a heat pump apparatus according to Embodiment 3 of the present invention.

FIG. 4 is a schematic diagram for illustrating a heat pump apparatus according to Embodiment 3 of the present invention. As illustrated in FIG. 4, the heat pump apparatus according to Embodiment 3 has a configuration in which the four-way valve 15 is omitted from the heat pump apparatus according to Embodiment 1, and a high and low-pressure heat exchanger 7 is arranged in the primary-side refrigeration cycle instead of the four-way valve 15. With this configuration, in the cascade heat exchanger 5, water and refrigerant flow in directions reverse to each other during the heating operation, but flow in directions parallel to each other during the cooling operation. The other configurations are simpler than those of Embodiment 1 and Embodiment 2. Detailed description thereof is thus omitted herein, and only an operation of the primary-side refrigeration cycle is described.

[Cooling Operation]

First, during the cooling operation, the four-way valve 2 in the primary-side refrigeration cycle is connected as indicated by the solid lines.

Gas refrigerant compressed into high-temperature and high-pressure gas refrigerant by the compressor 1 passes through the four-way valve 2 to flow into the outdoor heat exchanger 3. Then, the gas refrigerant exchanges heat with outdoor air in the outdoor heat exchanger 3, and rejects heat to the outdoor air so that the gas refrigerant itself is condensed into high-temperature and high-pressure liquid refrigerant. The liquid refrigerant flowing out of the outdoor heat exchanger 3 flows into a high-pressure side of the high and low-pressure heat exchanger. Then, the liquid refrigerant is subcooled in the high and low-pressure heat exchanger 7. The liquid refrigerant subcooled in the high and low-pressure heat exchanger 7 is expanded into low-temperature and low-pressure two-phase refrigerant by the expansion valve 4. The two-phase refrigerant flows into the heat source side of the cascade heat exchanger 5 acting as an evaporator. Then, the two-phase refrigerant exchanges heat with water circulating through the secondary-side refrigeration cycle in the cascade heat exchanger 5, and removes heat from the water to cool the water so that the two-phase refrigerant itself turns into low-temperature and low-pressure gas refrigerant. Then, the gas refrigerant flowing out of the heat source side of the cascade heat exchanger 5 passes through the four-way valve 2 to flow into a low-pressure side of the high and low-pressure heat exchanger 7. Then, the gas refrigerant is superheated in the high and low-pressure heat exchanger 7. The gas refrigerant superheated in the high and low-pressure heat exchanger 7 returns to the compressor 1.

At this time, when an outlet of the cascade heat exchanger 5 is brought into a saturated state, a superheated region is eliminated in the heat transfer area of the cascade heat exchanger 5 so that the entire heat transfer surface is effectively used. In such a case, a difference in performance between the case of the flow in the reverse directions and the case of the flow in the parallel directions is reduced. That is, an effect in the case of the flow in the reverse directions during the cooling operation is reduced, thereby being capable of omitting the four-way valve of the secondary-side circuit.

[Heating Operation]

Next, during the heating operation, the four-way valve 2 in the primary-side refrigeration cycle is connected as indicated by the dotted lines.

Gas refrigerant compressed into high-temperature and high-pressure gas refrigerant by the compressor 1 passes through the four-way valve 2 to flow into the heat source side of the cascade heat exchanger 5 acting as a condenser. Then, the gas refrigerant exchanges heat with water circulating through the secondary-side refrigeration cycle in the cascade heat exchanger 5, and rejects heat to the water to heat the water so that the gas refrigerant itself is condensed into high-temperature and high-pressure liquid refrigerant. The liquid refrigerant flowing out of the heat source side of the cascade heat exchanger 5 is decompressed into low-temperature and low-pressure two-phase refrigerant by the expansion valve 4. The two-phase refrigerant flows into the high-pressure side of the high and low-pressure heat exchanger 7. Then, the two-phase refrigerant is superheated in the high and low-pressure heat exchanger 7. The two-phase refrigerant superheated in the high and low-pressure heat exchanger 7 flows into the outdoor heat exchanger 3. Then, the two-phase refrigerant exchanges heat with outdoor air in the outdoor heat exchanger 3, and removes heat from the outdoor air so that the two-phase refrigerant itself is evaporated into low-temperature and low-pressure gas refrigerant. Then, the gas refrigerant flowing out of the outdoor heat exchanger 3 passes through the four-way valve 2 to flow into the low-pressure side of the high and low-pressure heat exchanger 7. Then, the gas refrigerant is subcooled in the high and low-pressure heat exchanger 7. The gas refrigerant subcooled in the high and low-pressure heat exchanger 7 returns to the compressor 1.

The high and low-pressure heat exchanger 7 is reduced in pressure both on the high-pressure side and the low-pressure side during the heating operation. Thus, a temperature difference sufficient for exchanging heat is not generated, thereby significantly reducing a heat exchange amount. In the cascade heat exchanger 5, the refrigerant and the water constantly flow in the directions reverse to each other, thereby being capable of obtaining a heat pump apparatus having high performance with high heat exchange efficiency.

In Embodiment 3, the high and low-pressure heat exchanger 7 is arranged in the primary-side refrigeration cycle, and sucked refrigerant is superheated in the high and low-pressure heat exchanger 7 during the cooling operation. Thus, an outlet of the cascade heat exchanger 5 can be brought into a wet state, thereby being capable of effectively utilizing the cascade heat exchanger 5.

As described above, in the refrigeration cycle apparatus according to the present invention, the heat pump apparatus includes the primary-side refrigeration cycle including at least the compressor 1, the outdoor heat exchanger 3, and the expansion valve 4, the secondary-side refrigeration cycle including at least the indoor heat exchanger 13 and the pump 11, and the cascade heat exchanger 5 configured to exchange heat between the primary-side refrigeration cycle and the secondary-side refrigeration cycle. In this heat pump apparatus, the microchannel heat exchanger having the fluid passage having small internal volume is used as the outdoor heat exchanger 3 and the cascade heat exchanger 5 in the primary-side refrigeration cycle configured to circulate refrigerant, thereby being capable of reducing the sealing amount of flammable refrigerant. Further, the primary-side refrigeration cycle includes the four-way valve 2, and the internal volume V1 of the fluid passage for refrigerant of the outdoor heat exchanger 3 and the internal volume V2 of the fluid passage for refrigerant of the cascade heat exchanger 5 are set to satisfy the relationship of $0.9<(V1/V2)<1.1$. Thus, the necessary sealing amount of refrigerant is substantially equal in both the cooling operation and the heating operation, thereby being capable of significantly reducing the sealing amount of flammable refrigerant.

Thus, the sealing amount of refrigerant can be set to be less than the permissible sealing amount of refrigerant of the European Standards (for example, IEC standards) (about 150 g in the case of propane). Further, the necessary sealing amount of refrigerant is substantially equal in both the cooling operation and the heating operation. Thus, the refrigerant storage tank configured to absorb the refrigerant in amounts different between the two operations is unnecessary.

In this manner, the heat pump apparatus with high safety and high degree of freedom in installation can be obtained.

The invention claimed is:

1. A heat pump apparatus, comprising:

a heat source-side refrigeration cycle sequentially connecting a compressor, a heat source-side heat exchanger, an expansion valve, and a heat source side of a cascade heat exchanger, the heat source-side refrigeration cycle being configured to circulate refrigerant; and a load-side refrigeration cycle sequentially connecting a heat medium sending unit, a load-side heat exchanger, and a load side of the cascade heat exchanger, the load-side refrigeration cycle being configured to circulate a heat medium, the refrigerant being flammable refrigerant or slightly flammable refrigerant, the heat source-side heat exchanger and the cascade heat exchanger each having a hydraulic diameter of less than 1 mm, which is calculated by $4\times S/L$, where S represents a cross-sectional area of a fluid passage and L represents a length of a wetted perimeter, wherein the heat source-side refrigeration cycle further includes a flow switching device, and wherein, when V1 represents an internal volume of a fluid passage for the refrigerant of the heat source-side heat exchanger and V2 represents an internal volume of a fluid passage for the refrigerant of the cascade heat exchanger, V1 and V2 are set to satisfy a relationship of $0.9<(V1/V2)<1.1$, wherein a sealing amount of the refrigerant required for operating the heat pump apparatus is substantially equal in both a cooling operation and a heating operation, wherein Hall there is no refrigerant storage tank in the heat source-side refrigeration cycle.

2. The heat pump apparatus of claim 1, wherein the flow switching device of the heat source-side refrigeration cycle includes a four-way valve or four on-off valves.

3. The heat pump apparatus of claim 1, wherein the heat source-side heat exchanger further includes header distributors arranged in upper and lower parts of the heat source-side heat exchanger.

4. The heat pump apparatus of claim 1, wherein the heat source-side refrigeration cycle further includes a high and low-pressure heat exchanger, and wherein, during the heating operation, the refrigerant and the heat medium flow in directions reverse to each other in the cascade heat exchanger.

5. The heat pump apparatus of claim 1, wherein the load-side refrigeration cycle further includes a flow switching device, and wherein, during both the cooling operation and the heating operation, the refrigerant and the heat medium flow in directions reverse to each other in the cascade heat exchanger, and the heat medium and air flow in directions reverse to each other in the load-side heat exchanger.

6. The heat pump apparatus of claim 5, wherein the flow switching device of the load-side refrigeration cycle includes a four-way valve or four on-off valves.

7. The heat pump apparatus of claim 1, wherein the heat source-side refrigeration cycle includes two or more heat source-side refrigeration cycles connected to the load-side refrigeration cycle in parallel, and the sealing amount, which is substantially equal, includes the two or more heat source-side refrigeration cycles connected in parallel to the load-side refrigeration cycle.

8. The heat pump apparatus of claim 7, wherein the heat source-side refrigeration cycle further includes a high and low-pressure heat exchanger, and wherein, during the heating operation, the refrigerant and the heat medium flow in directions reverse to each other in the cascade heat exchanger.

9. The heat pump apparatus of claim 7, wherein the load-side refrigeration cycle further includes a flow switching device, and wherein, during both the cooling operation and the heating operation, the refrigerant and the heat medium flow in directions reverse to each other in the cascade heat exchanger, and the heat medium and air flow in directions reverse to each other in the load-side heat exchanger.

10. The heat pump apparatus of claim 9, wherein the flow switching device of the load-side refrigeration cycle includes a four-way valve or four on-off valves.

* * * * *